US007702267B2

(12) United States Patent
Campbell et al.

(10) Patent No.: US 7,702,267 B2
(45) Date of Patent: Apr. 20, 2010

(54) APPARATUS AND METHOD FOR TRANSFER OF IMAGE FORMING SUBSTANCES

(75) Inventors: Alan Stirling Campbell, Lextington, KY (US); Scott Richard Castle, Lexington, KY (US); Gary Allen Denton, Lexington, KY (US); Jarrett Clark Gayne, Lexington, KY (US); Jason Edward Gordon, Nicholasville, KY (US); Royden Thomas Kern, Lexington, KY (US); Julie Ann Gordon Whitney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 878 days.

(21) Appl. No.: 11/456,113

(22) Filed: Jul. 7, 2006

(65) Prior Publication Data

US 2008/0008504 A1 Jan. 10, 2008

(51) Int. Cl.
*G03G 15/08* (2006.01)

(52) U.S. Cl. ..... 399/281

(58) Field of Classification Search ..... 399/281
See application file for complete search history.

(56) References Cited

U.S. PATENT DOCUMENTS 4,930,438 A 6/1990 Demizu et al.
5,016,560 A 5/1991 Asada et al.
5,655,197 A 8/1997 Okada et al.
6,072,975 A 6/2000 Kyung
6,671,485 B2 * 12/2003 Hirano ..... 399/284
6,829,464 B2 12/2004 Haraguchi et al.
2003/0118377 A1 * 6/2003 Hirano ..... 399/284
2005/0207786 A1 9/2005 Askren et al.
2006/0029436 A1 * 2/2006 Toyoda et al. ..... 399/279

* cited by examiner

*Primary Examiner*—David M Gray
*Assistant Examiner*—Ruth N Labombard
(74) *Attorney, Agent, or Firm*—Steven J. Grossman; John Victor Pezdek

(57) ABSTRACT

The present invention relates to a device or method which may reduce starvation in the transfer of an image forming substance to a developing location within an image forming apparatus. The device may include a first roller having a surface which is capable of supplying an image forming substance to a developing location. A second roller may then be included having a surface in rotating contact with the first roller. The second roller is capable of supplying image forming substance to the first roller. The second roller may comprise foam having a specified porosity, electrical conductivity, and/or be configured to rotate in a desired direction and/or desired speed relative to the first roller.

7 Claims, 3 Drawing Sheets

APPARATUS AND METHOD FOR TRANSFER OF IMAGE FORMING SUBSTANCES

FIELD OF INVENTION

The present invention relates to an apparatus and a method for the transfer of an image forming substance which may then reduce starvation within an image forming apparatus. The image forming apparatus may include printers, electrophotographic printers, copiers, faxes, all-in-one devices and multi-functional devices.

BACKGROUND

An image forming apparatus may generally utilize a number of devices to transfer and deliver an image forming substance, such as toner, to the image developing system. Often these devices may be located within a toner cartridge, however, this is not always the case. A toner sump or reservoir may be used in an image forming device to retain toner until it is required by the developer system. The image forming substance may be transferred from the sump or reservoir using a series of component rollers, which may ultimately transfer the image forming substance to the image developer system. When the transfer of image forming substance in the image forming apparatus is relatively poor, and inadequate image forming substance is delivered to the image development system, a phenomenon called starvation may occur which may then yield an irregular printing pattern.

SUMMARY

In a first exemplary embodiment, the present invention relates to a device or method for reducing starvation in the transfer of an image forming substance to a developing location within an image forming apparatus. The device may include a first roller having a surface which is capable of supplying an image forming substance to a developing location. A second roller may then be included having a surface in rotating contact with the first roller which second roller is capable of supplying image forming substance to the first roller. The second roller may comprise foam having greater than or equal to about 50 pores per inch. The foam may be electrically conductive or contain electrically conductive additive.

In a second exemplary embodiment, the present invention relates to a device or method for reducing starvation in the transfer of an image forming substance to a developing location within an image forming apparatus. The device may include a first roller having a rotating surface that is capable of supplying an image forming substance to the developer location. A second roller may then be provided having a surface in rotating contact with the first roller which is also capable of supplying image forming substance to the first roller. The surfaces of the first and second rollers in rotating contact may then form a nip and the surfaces at the nip may then be configured to move in substantially opposing directions. The first roller may also be capable of rotating to provide a surface speed $S_1$ and the second roller may be such that it is capable of rotating to provide a surface speed $S_2$ wherein the value of $S_2/S_1$ in the range of about 0.1-4.0.

BRIEF DESCRIPTION OF DRAWINGS

The detailed description below may be better understood with reference to the accompanying figures which are provided for illustrative purposes and are not to be considered as limiting any aspect of the invention.

DETAILED DESCRIPTION

The present invention may now be described in connection with an image forming device such as an electrophotographic printer, which may rely upon the use of an image forming substance such as toner, and which may rely upon the indicated rollers, such as a TAR and TASR. However, the present invention may be understood and is contemplated for use on any image forming device which may provide printing and/or copying capability, and which may rely upon the transfer and/or conveyance of an image forming substance (other than toner) within the device. In addition, the present invention may be positioned within a printer cartridge such as a toner cartridge that may be used in an electrophotographic device such as a laser printer.

Accordingly, in the exemplary image forming apparatus, an image forming substance, such as toner, may be transferred from a sump or reservoir to a photoconductive element using one or more components, such as one or a plurality of rollers. For example, the image forming substance may be transferred from a reservoir to what may be described as a toner adder roller (TAR). The TAR may then transfer and supply toner to what may be described as a developer roller, which may in turn transfer toner to a photoconductive element. This transfer, supply or depositing of toner on the TAR component may now be improved by the use of an additional component, which may by way of example be termed to a toner adder scrubber roller (TASR). The TASR may therefore be first recognized as a roller which is in rotational contact with the TAR to form a nip, and which may rotate in the same direction as the TAR or in an opposite direction. In addition, the TASR may optionally serve to scrub the TAR, which may be understood as that situation where the TASR may be in contact with the TAR and rotate with a different surface speed than the TAR.

Figure 1:
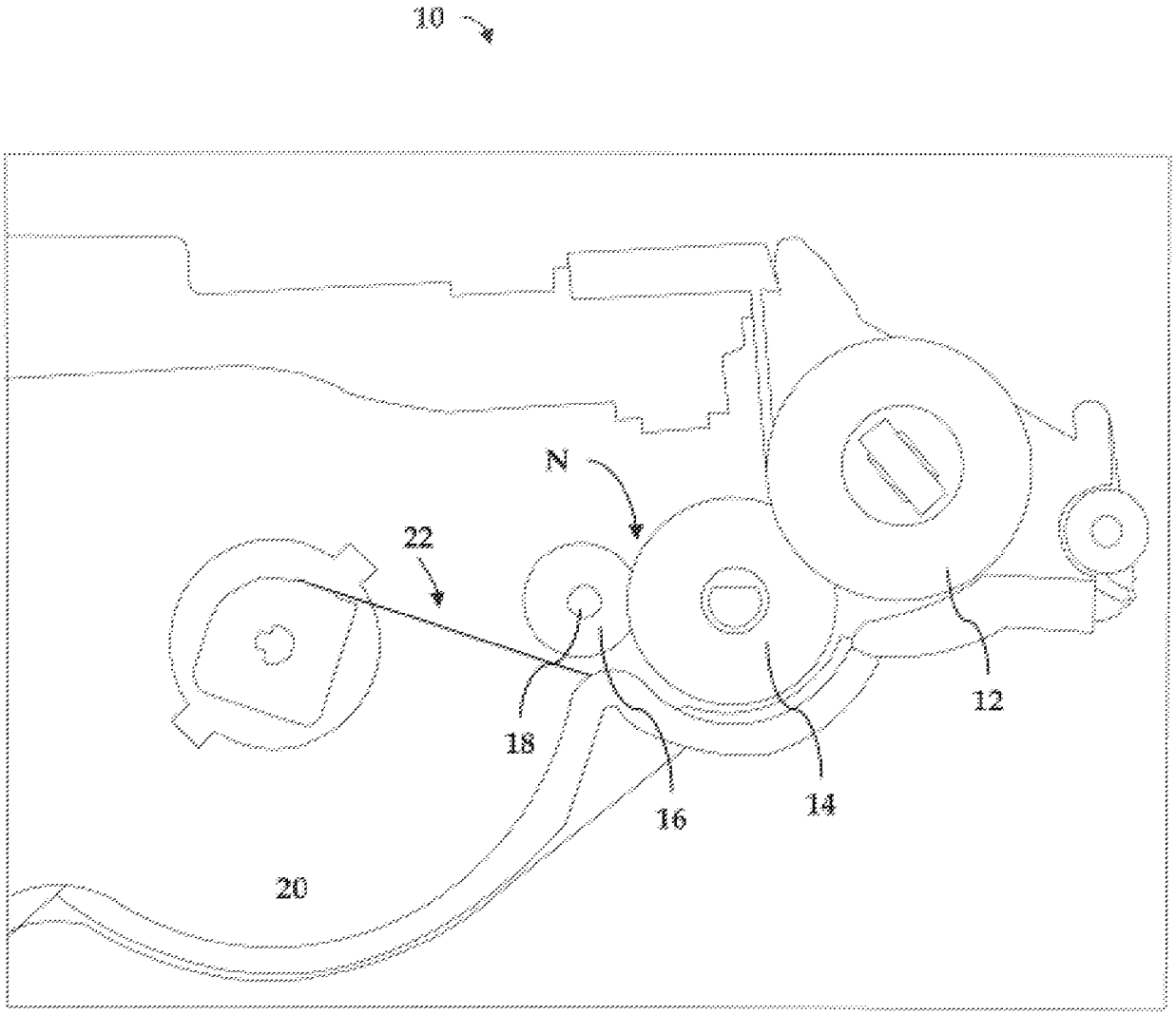
FIG. 1 is a side view of a developer roller, a toner adder roller (TAR) and a toner adder scrubber roller (TASR).

Illustrated in FIG. 1 is a portion of an image forming device 10 depicting the relative positional relationship between a first component 14 (e.g. a TAR) and a second component 16 (e.g. TASR). The TASR may include a shaft 18. It is again worth emphasizing that although the present invention is now being described in connection with the use of toner and rollers, the present invention is contemplated for use with image forming substances other than toner and with components other than rollers. Accordingly, the exemplary image forming device herein may be a device for developing an electrostatic latent image by applying toner to the latent image at a developing location. The image forming device may next include a region 20 which may be understood as a sump or reservoir for accommodating toner. A paddle 22 may also be included which may assist in transfer of toner towards the TASR 16. In addition, a developer roller 12 is illustrated, which may then be in contact with a photoconductive surface (not shown). As can be seen, a nip N may be formed between the TAR 14 and the TASR 16.

The TAR 14 may be composed of a polymeric material, such as a rubber elastomer or foam, including open cell foam, which may be disposed on a conductive shaft. The conductive shaft may include a conductive polymeric material or a metallic material such as stainless steel, aluminum, copper, alloys, etc. The polymeric materials may include polyurethane, EPDM based copolymer, polyisoprene, polyester, polypropylene, neoprene or silicone. A conductive additive may be incorporated into the polymeric material which may therefore include carbon, including carbon black and other carbon based material such as graphite, carbon nanotubes and carbon nanofibers, conductive polymeric material, ionic additives, metal particles, combinations of such additives, etc. The polymeric material may have a resistivity between about $1\times10^5$ to $1\times10^{10}$ ohm-cm. An electrical bias may also be applied to the TAR. The TAR may also have an outer diameter in the range of about 10 to 20 mm, including all values and increments therein. One suitable material for the TAR includes EPT51 foam from Bridgestone, which is identified as a conductive open cell carbon loaded urethane foam.

The TASR 16 may similarly be composed of a polymeric material, which polymeric material may specifically be in the form of a porous type structure in the sense that the polymeric material has some measure of porosity. One example of the feature of porosity may include a cellular structure, wherein the polymeric material may define cell wall sections and a plurality of cells. Such cellular structure may therefore be open and/or closed cell type material. An open cell structure may be understood herein as a cell structure wherein there is an opening in a cell wall and one cell chamber interconnects with another cell chamber. Accordingly, the TASR herein may rely upon the use of a foam material that has some amount of open cell structure. The open cell structure may also specifically include foam wherein more than about 50% of the cells are open cell. Moreover, the foam material may have cell structure wherein between about 50-100% of the cells are open cell including all values and increments therein. The foam material herein may also rely upon the use of closed cell structure. For example, foam material wherein more than about 50% of the cells are closed cell, including all values and increments between about 50%-100%. A closed cell structure may be understood herein as a cell structure wherein cell walls separate the individual cells and the cell chambers do not interconnect. However, in the context of the present invention, foam material containing open cells or having a substantially open cell structure is preferred.

The polymeric materials for the TASR may therefore include polyurethanes, EPDM type polymers, polyisoprenes, polyesters, polypropylenes, neoprene or silicone type resins. In addition, the foam may have greater than or equal to about 50 pores per inch (ppi) which may be expressed as $\geqq$50 ppi. The foam may also specifically have between about 50-500 ppi, including all values and increments therein. In such regard, pore size may be selected to optimize the toner mass that may be transferred. For example, the foam for the TASR may rely upon a foam having about 80-100 ppi. The foam may also have a coefficient of friction (COF) of between about 0.5-2.5 and a density of between about 5-25 pounds per cubit foot (pcf). A suitable foam may therefore include foam material such as ENDUR® C Microcellular Urethane available from Inoac Corporation. Such foam may also provide relatively uniform cell structure distribution with an average cell size of about 150 μm (largest available cross-section). However, the foam herein may have an average cell size of less than 400 μm. Furthermore, the average cell size of the foam may be in the range of about 50 μm to 400 μm, including all values and increments therein, e.g., 150 μm, 200 μm, etc. In addition, it may be noted that it may be desirable to provide a TASR that has an average cell size that is less than or equal to the average cell size of the TAR. Such control of average cell size may be influenced by control of the number of pores per inch (ppi) as discussed above. For example, an increase in the number of pores per inch may provide a reduction in the average cell size, and a decrease in the number of pores per inch may provide an increase in the average cell size.

It may therefore be appreciated that the image forming media (e.g. tone particles) may be physically contained in the above referenced foam material and such foam material may more efficiently reload itself with toner during the course of an image forming operation and such foam may also transfer such toner to the TAR such that the density of the toner image is maintained at a desirable and/or substantially constant level. Accordingly, the outermost surface of the TAR may not become depleted of toner to some undesirable level and may be adequately supplied with toner as it rotates.

The foam of the exemplary TASR may also include a conductive additive. The conductive additive may be applied via slurry bath to the foam or by other coating methods such as spray coating, etc. The conductive additive may therefore be located primarily at the foam surface. For example, where the foam itself has a thickness of between about 5-10 mm, the conductive additive may be substantially and/or completely concentrated within a portion of the surface to a desired depth, e.g. a depth of 1-2 mm, including all values and increments therein. For example, in the event that the foam has a thickness of about 8 mm, the conductive additive may penetrate the foam to a thickness of about 1 mm. In addition, the conductive additive may be present substantially throughout the foam and may be present in an amount of greater than about 10% (wt) and may amount to 10-90% (wt) of the foam, including all values and increments therein. The conductive additive may include carbon, including carbon black and other carbon based material such as graphite, carbon nanotubes and carbon nanofibers, conductive polymeric material, ionic additives, metal particles, combinations of such additives, etc. The conductive additives may have an average particle diameter in the range of about 10 to 1000 nm, including all values and increments therein. Furthermore, the particles may exhibit a surface area as measured by the BET method (Nitrogen), ASTM D3037-89 of between 10 and 1000 $m^2/g$, including all values and increments therein. Furthermore, the volume resisivity imparted by the conductive particles may be in the range of about $1.0\times10^{12}$ to $1.0\times10^2$ ohm-cm, depending on the amount of particles incorporated by weight.

As illustrated, the TASR 16 may include a shaft or core 18 that includes a polymeric material or metallic material. A polymeric shaft may include a number of materials such as polyamide, polystyrene, polypropylene, etc. In addition, the polymeric shaft may include conductive additives, such as those described above or may be coated with a conductive layer such as aluminum or nickel. The shaft may also include metals or be plated or coated with a conductive material, such as stainless steel, aluminum, etc.

An exemplary TASR herein may have an overall diameter (shaft and foam) of between about 5 to 20 mm, including all values and increments therein. The TASR may also have a shaft length in the range of about 150 to 300 mm, including all values and increments therein. In addition, the TASR may be positioned with about a 0.2 to 1.5 mm interference (overlapping regions) between the TASR and the TAR component. In an exemplary embodiment the interference between the TASR and TAR may be in the range of 5 to 20% of any specified diameter of the TASR, including all values and increments therein. Accordingly, the interference may compress the shape of the foam utilized in the TASR and/or the TAR.

Electrical biasing of either or both of the TASR and/or TAR is an additional option. For example, if the TAR is biased, and the TASR is not biased, any physical contact between the TAR and the TASR may provide that the TASR may maintain about the same potential to the TAR voltage potential. Furthermore, the TASR could be biased (e.g., by biasing the shaft of the TASR) to a potential that is equal to, less than or greater than the biasing potential applied to the TAR. By such use of differences in potential additional toner may be supplied/deposited to the TAR from the TASR, beyond that which may be supplied by the foam itself. Furthermore, it should also be appreciated that the toner may be tribocharged due to frictional engagement with the conductive foam material of the rollers.

During transfer of an image forming substance, it has also been recognized herein that the surface velocities of the TASR and the TAR may be advantageously controlled. For example, the surface velocities may be substantially the same or varied and such may influence the above described variable of toner starvation. For example, the TAR may rotate at a first peripheral speed ($S_1$) and the TASR component may rotate at a second peripheral speed ($S_2$) wherein $S_2/S_1$=SR, wherein SR is the ratio of surface velocities or speed ratio. Accordingly, the value of SR may fall in the range of 0.1 to 4. Furthermore, the TASR and the TAR component may rotate in the same direction or in opposite directions. When rotating in the same direction it can be appreciated that this will provide the situation that at the nip location ("N" in FIG. 1) the surfaces of the two rollers will be moving in generally opposing directions. When the TASR and TAR components are configured to rotate in opposite directions (e.g., one clockwise and one counterclockwise) the surfaces defining the nip "N" may then be moving in substantially the same direction.

Figure 2:
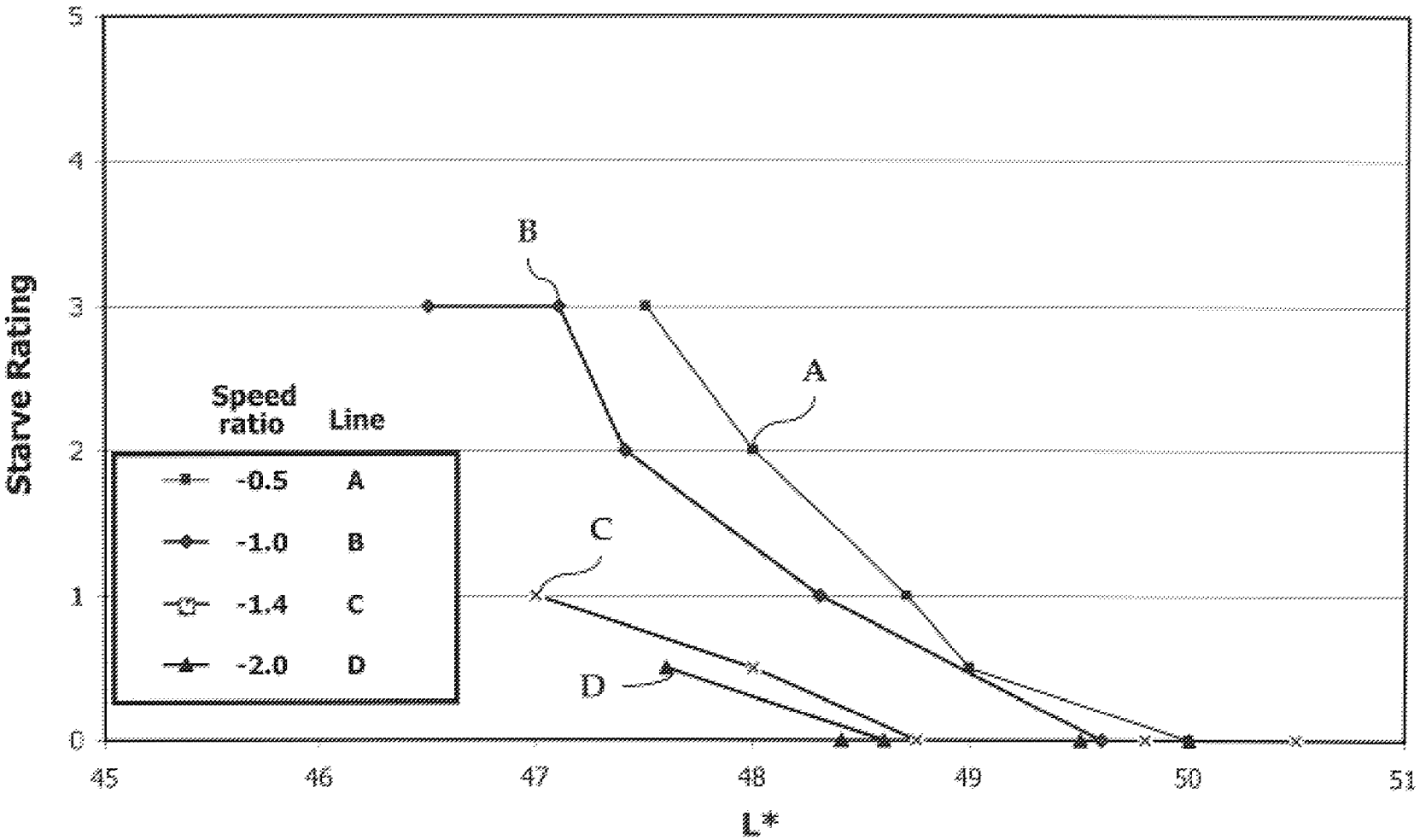
FIG. 2 is a graph of starve rating versus L* (relative lightness) at different negative surface sped ratios (ratio of surface velocity of the TASR to the TAR).

FIG. 2 illustrates the results of a starvation experiment for the 3$^{rd}$ of 3 cyan solid area printed pages, utilizing that combination of the TASR and TAR, wherein the speed ratio SR has a value of −0.5, −1.0, −1.4 and −2.0. A negative SR is simply reference to the situation noted above wherein the TASR and the TAR are rotating in the same direction and the surfaces of the two rollers will be moving in generally opposite direction at the nip location. As can be seen from this graph, the starve rating may be plotted against the value of L*. L* may be understood as a measure of the relative lightness of the color (L*=0 yields black and L*=100 indicates white). A shift of 1 L* corresponds to a change in toner density (mg/cm$^2$) of about 5%, with lower L* values associated with higher rates of toner usage and delivery. In the case of starve rating, a value of 5 is relatively severe starvation (e.g. irregular patterns of relatively light print) and the value of 0 is that situation where relatively little or no starvation is observed. Accordingly, FIG. 2 confirms that more negative speed ratios (higher velocity of the TASR relative to the TAR) are relatively more effective at reducing starvation.

Figure 3:
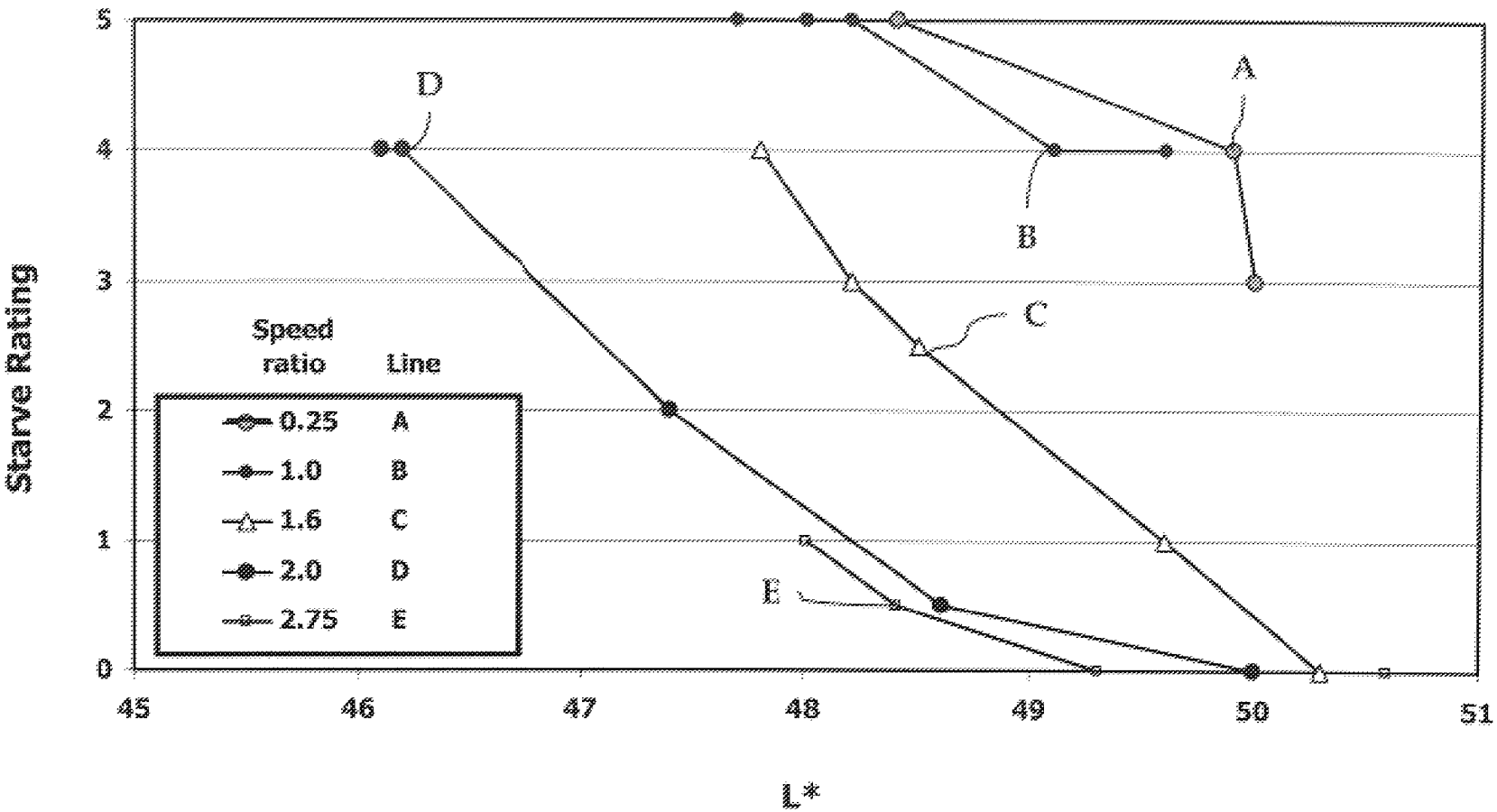
FIG. 3 is a graph of starve rating versus L* (relative lightness) at a different positive surface speed ratios (ratio of surface velocity of the TASR to the TAR).

FIG. 3 illustrates that situation wherein the TASR is rotated in opposite direction to the TAR, thereby providing that situation wherein the surfaces of the two rollers are moving in the same direction at the nip location. This may then be assigned the convention of a positive value for the speed ratio. The speed ratios considered in FIG. 3 are 0.25, 1.0, 1.6, 2.0 and 2.75, and similar to the above, an increase in speed ratio again is more effective at reducing starvation. In addition, it is worth comparing, e.g., curve C in FIG. 2 with curve C in FIG. 3. As can be seen, for approximately the same speed ratio and L* value, starvation is more effectively reduced in that situation where the TASR and the TAR are rotating in the same direction where the surfaces of the two rollers are moving in opposite direction at the nip location.

The foregoing description is provided to illustrate and explain the present invention. However, the description hereinabove should not be considered to limit the scope of the invention set forth in the claims appended hereto.

What is claimed is:

1. A device for reducing starvation in the transfer of an image forming substance to a developing location within an image forming apparatus:

a first roller having a rotating surface which is in rotating contact with a developer roller and forming an intermediate supply location at a nip formed by the surface of the first roller in rotating contact with the developer roller, the first roller supplying an image forming substance to the intermediate supply location formed between the first roller and the developer roller;

a second roller having a surface in rotating contact with said first roller and forming a first supply location at a nip formed by the surface of the second roller in rotating contact with the first roller, the second roller supplying image forming substance to the first supply location formed between the second roller and said first roller, said surfaces of said first and second rollers in rotating contact forming a nip and wherein said surfaces at said nip move in substantially opposing directions; and said first roller rotates at a surface speed $S_1$ and said second roller rotates at a surface speed $S_2$ and wherein the value of $S_2/S_1$ falls in the range of about 0.1-4.0.

2. The device of claim 1 wherein said second roller comprises foam having ≧about 50 pores per inch.

3. The device of claim 1 wherein said wherein said first roller comprises foam material having an average cell size and said second roller comprises foam material having an average cell size, and said average cell size of said second roller is less than or equal to said average cell size of said first roller.

4. The device of claim 1, wherein the developer roller is further in rotating contact with a photoconductive roller and forming the developing location at a nip formed by the surface of the developer roller in rotating contact with the photoconductive roller, the developer roller supplying the image forming substance to the developing location formed between the developer roller and the photoconductive roller.

5. A method for reducing starvation in the transfer of an image forming substance within an image forming apparatus comprising:

supplying a first roller having a surface which is in rotating contact with a developer roller and forming an intermediate supply location at a nip formed by the surface of the first roller in rotating contact with the developer roller, the first roller supplying an image forming substance to the intermediate supply location formed between the first roller and the developer roller and a second roller having a surface in rotating contact with said first roller and forming a first supply location at a nip formed by the surface of the second roller in rotating contact with the first roller, the second roller supplying image forming substance to the first supply location formed between the second roller and said first roller, said second roller comprising foam about 50 pores per inch;

rotating said first roller to provide a surface speed $S_1$; and rotating said second roller to provide a surface speed $S_2$ wherein the value of $S_2/S_1$ falls in the range of about 0.1-4.0.

6. The method of claim 5 wherein said surfaces of said first and second rollers are moving in substantially opposing direction.

7. The method of claim 5, wherein the developer roller is further in rotating contact with a photoconductive roller and forming the developing location at a nip formed by the surface of the developer roller in rotating contact with the photoconductive roller, the developer roller supplying the image forming substance to the developing location formed between the developer roller and the photoconductive roller.

* * * * *